United States Patent [19]

Toi

[11] 4,033,233

[45] July 5, 1977

[54] FLUID PRESSURE OPERABLE SERVO POSITIONER

[75] Inventor: Toshio Toi, Kobe, Japan

[73] Assignee: Nippon Air Brake Company Ltd., Kobe, Japan

[22] Filed: July 7, 1975

[21] Appl. No.: 593,742

[30] Foreign Application Priority Data

Aug. 30, 1974 Japan ..... 49-99771

[52] U.S. Cl. ..... 91/374; 91/382; 91/387; 91/461; 92/131; 91/448

[51] Int. Cl.[2] ..... F15B 13/16; F15B 9/10

[58] Field of Search ..... 92/131, 382, 417, 374, 92/387

[56] References Cited

UNITED STATES PATENTS

| | | | |
|---|---|---|---|
| 2,092,580 | 9/1937 | Kelly | 92/131 |
| 2,344,768 | 3/1944 | Dodson | 91/382 |
| 2,945,449 | 7/1960 | Febvre et al. | 92/131 |
| 2,966,891 | 1/1961 | Williams | 91/387 |
| 3,168,854 | 2/1965 | Neilson | 92/131 |
| 3,875,849 | 4/1975 | Patel | 91/417 R |

FOREIGN PATENTS OR APPLICATIONS

| | | | |
|---|---|---|---|
| 986,260 | 2/1948 | France | 91/382 |

*Primary Examiner*—Paul E. Maslousky
*Attorney, Agent, or Firm*—R. S. Visk; R. W. McIntire, Jr.

[57] ABSTRACT

A fluid pressure operable servo positioner for selectively positioning a mechanical member or lever by a power cylinder selectively positionable in accordance with the degree of operating fluid pressure supplied thereto through a control valve device at a pressure determined by the degree of a selectively variable control pressure supplied to the control valve device, the power cylinder including a counteracting spring for balancing the force of the operating pressure to maintain the power cylinder in the selected position and a cam member engaging the control valve device and positionable according to the position of the power cylinder for maintaining the control valve device in the selected pressure supply position.

2 Claims, 2 Drawing Figures

FLUID PRESSURE OPERABLE SERVO POSITIONER

BACKGROUND OF THE INVENTION

Figure 1:
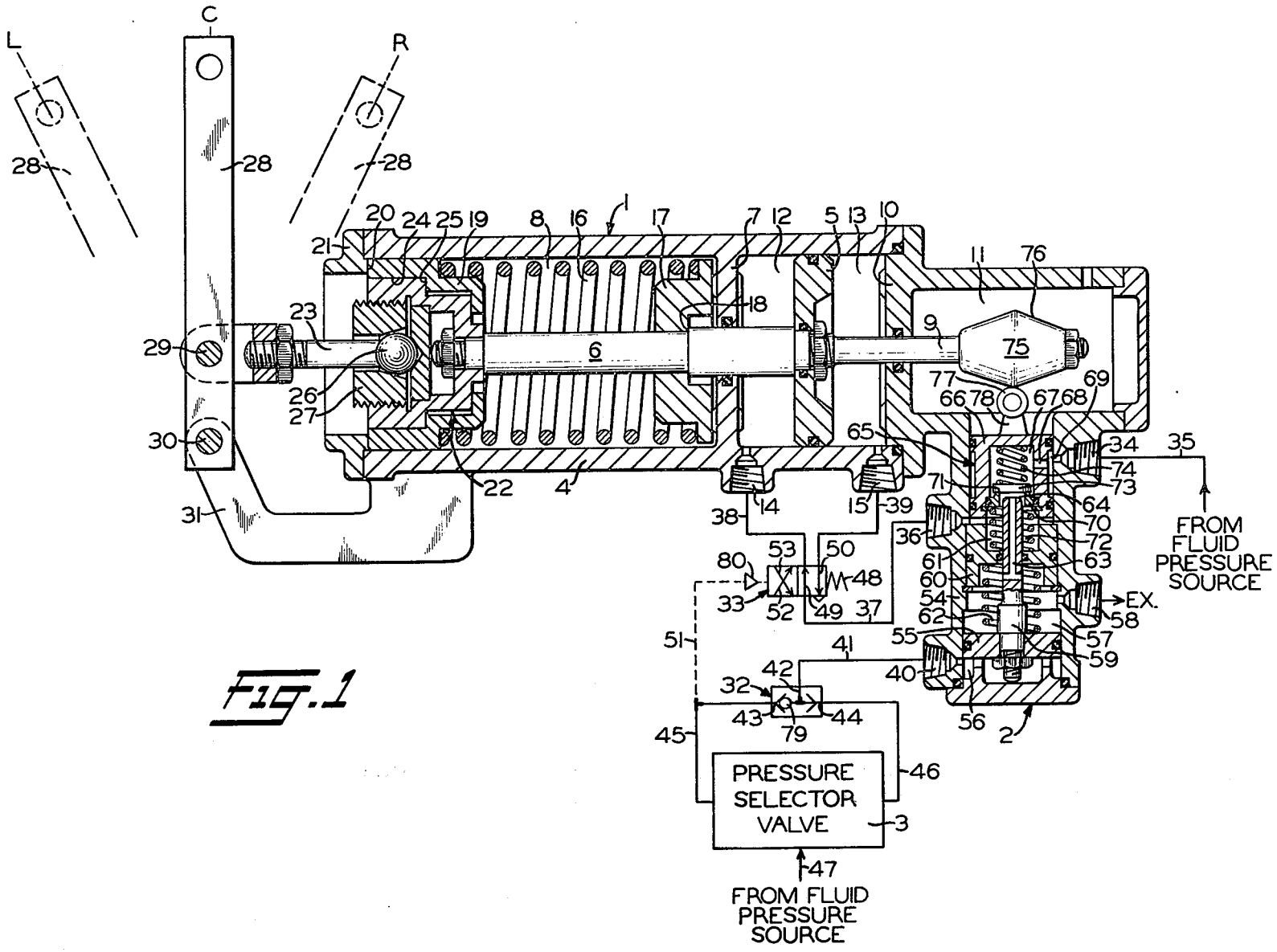

Since servo positioners are used for precise controlling of such equipment, for example, as variable pitch propellers for marine equipment, engine governors, steering mechanisms, steam valves, throttles, or for positioning potentiometers, butterfly valves, hopper gates, torque converters, or hydrostatic transmissions, it is important that the servo positioner be positive in its action, quick to respond to a control impulse, and be positionally stable and free of hysteresis.

SUMMARY OF THE INVENTION

The object of the present invention, therefore, is to provide a servo positioner having the ability to respond to a control impulse without hesitation and to positively operate a lever or machine member to a precise position desired and to maintain said lever or machine member in the selected position without variation unless a change in position is deliberately effected by the operator.

Briefly, the invention comprises a fluid pressure operable servo positioner including a power cylinder having a piston and piston rod for positioning the lever or machine member responsively to operating fluid supplied to and acting on the piston under the control of a control valve device at a pressure in accordance with the degree of control pressure supplied to the valve device, as selected by the operator, said power cylinder further including force balancing means for opposing and balancing the force exerted by said operating fluid, and cam means carried at one end of the piston rod and engageable with said valve device to provide a feedback force acting on and by which the valve device is positively maintained in the selected control position.

Figure 2:
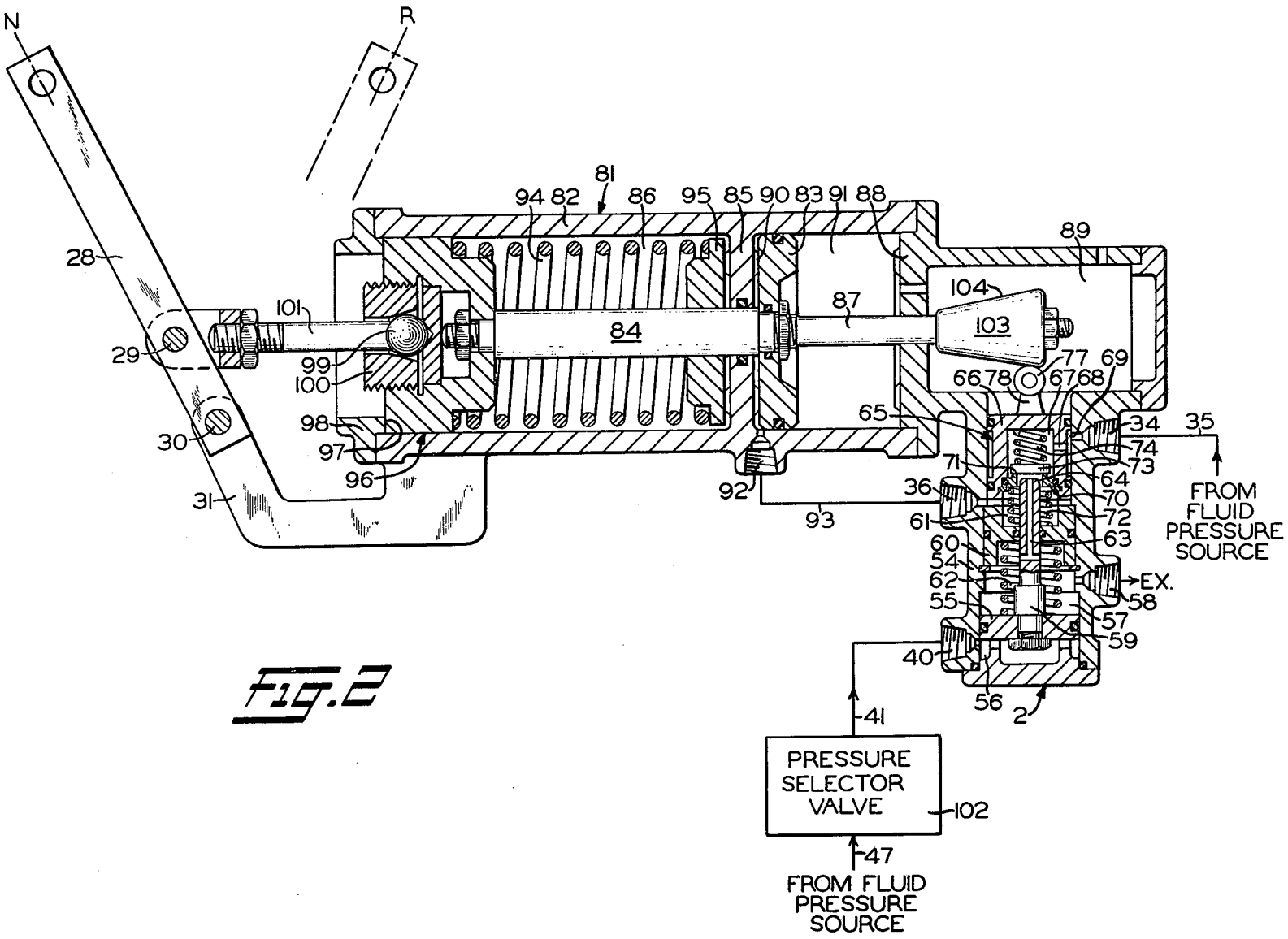

In the drawings,

FIG. 1 is an elevational view, mostly in section, of a fluid pressure operable servo positioner characterized by a double-acting operating piston, and FIG. 2 is an elevational view, mostly in section, of a modified version of the servo positioner shown in FIG. 1 and characterized by a single-acting operating piston.

DESCRIPTION AND OPERATION

As shown in FIG. 1, a servo positioner embodying the invention generally comprises a power cylinder device 1, a control valve device 2, and a pressure selector valve device 3.

The power cylinder device 1 comprises a casing 4 having a double-acting piston 5 reciprocably operable therein, said piston having a lever-positioning rod 6 extending concentrically from one side thereof with sealing and sliding relation through a separating wall 7 into a spring chamber 8 formed at one end of said casing. A cam operating rod 9 extends concentrically from the other side of piston 5 with sealing and sliding relation through a separating wall 10 into a cam chamber 11 formed at the end of casing 4 opposite spring chamber 8. Piston 5 cooperates with casing 4 and separating walls 7 and 10 to form respective operating pressure chambers 12 and 13 on opposite sides of said piston and to which chambers fluid pressure may be alternatively supplied, as will hereinafter be disclosed, via respective ports 14 and 15.

Force balancing means in the power cylinder device 1 comprises a return spring 16 compressedly disposed between a spring seat 17 abuttingly engaging a shoulder 18 formed on the inner end of rod 6 for moving with and biasing said rod and, therefore, piston 5 in a rightwardly direction, as viewed in FIG. 1, and a spring seat member 19 slidably coaxially movable within spring chamber 8. Axial movement of spring seat 19 in a leftwardly direction is limited by abutting engagement thereof with a shoulder 20 of a retaining member 21 secured at the end of casing 4 adjacent spring chamber 8.

A ball and socket assembly 22, including an extension member 23, is secured to the free end of rod 6 and axially reciprocably movable therewith within a bore 24 formed in spring seat 19, such axial movement being limited in a leftwardly direction by abutting contact of piston 5 with separating wall 7 and in a rightwardly direction, within bore 24, by abutting contact with a shoulder 25 formed in said spring seat. One end of extension member 23 comprises a ball 26 rollingly secured in conventional manner in a socket member 27 of the ball and socket assembly 22, the other end of said extension member being pivotally connected to a lever 28 at a point 29 between the ends of said lever. One end of lever 28 is pivotally connected at a fulcrum 30 to a bracket 31 secured to casing 4. Thus, axial movement of piston 5 and, therefore, of rod 6 causes rotation of lever 28 about fulcrum 30 either in a clockwise or counterclockwise direction, depending upon the direction of said axial movement of said piston and rod, as determined by which of the pressure chambers 12 or 13 is pressurized.

Supply of operating pressure to one or the other of chambers 12 or 13 via one of the ports 14 or 15, respectively, is effected by the control or relay valve device 2 in cooperation with pressure selector valve device 3, a double check valve device 32, and a changeover valve device 33.

Relay valve device 2 is provided with a supply port 34 to which a source of fluid under pressure in the form of a pipe 35 is connected, said pipe, in turn, being connected to a main source of fluid under pressure such as a storage reservoir (not shown). A delivery port 36 in relay valve device 2 is connected via a pipe 37 to the inlet side of changeover valve device 33, which in turn has the outlet side thereof connected by pipes 38 and 39 to ports 14 and 15, respectively, of cylinder device 1. Relay valve device 2 is also provided with a control port 40 connected by a pipe 41 to an outlet port 42 of double check valve device 32, the latter having oppositely disposed inlets 43 and 44 connected by pipes 45 and 46 to opposite outlet sides, respectively, of pressure selector valve device 3. Selector valve device 3 is connected on the inlet side to a source of fluid under pressure comprising a pipe 47 which may be supplied by the same source as that supplying pipe 35.

Changeover valve device 33 is normally biased by a spring 48 to a first supply position in which it is diagrammatically shown in FIG. 1 and in which pipe 37 is placed in communication, via a supply passageway 49, with pipe 38 so that fluid pressure may be supplied from delivery port 36 of relay valve device 2 to port 14 and chamber 12 of cylinder device 1, while pipe 39 and, therefore, chamber 13 are exhausted to atmosphere via an exhaust passageway 50. When the side of changeover valve 33 opposite biasing spring 48 is subjected to fluid pressure, in a manner to be hereinafter explained, via a branch pipe 51 connected to pipe 45 and sufficient for overcoming the effect of said spring, the changeover valve device is shifted from its first position, above defined, to a second position in which pipe 37 is communicated, via a supply passageway 52, to pipe 39 and, therefore, to chamber 13 so that fluid pressure may be supplied from delivery port 36 to said chamber, while pipe 38 and, therefore, chamber 12 are exhausted to atmosphere via an exhaust passageway 53.

Relay valve device 2 comprises a casing 54 secured at right angles to the end of casing 4 adjacent separating wall 10. Casing 54 has coaxially operable therein a control piston 55 having a control pressure chamber 56 formed adjacent one side thereof and opening to control port 40, and having an atmospheric chamber 57 formed adjacent the opposite side thereof and open to atmosphere via an atmospheric port 58 formed in said casing. A piston stem 59 fixed to control piston 55 extends coaxially therefrom through atmospheric chamber 57 and slidingly sealingly through a concentric bore of a transverse wall of a guide bushing 60 coaxially secured in case 54 between the ends thereof, said transverse wall serving to separate said atmospheric chamber from a delivery chamber 61 adjacent the opposite side of said wall and into which said stem extends.

A spring 62 is compressed between control piston 55 and the transverse wall of guide bushing 60 for urging said piston and piston stem 59 downwardly, as viewed in the drawings. Piston stem 59 has a coaxially disposed passageway 63, the upper end of which opens at the upper end of said stem to form an exhaust valve seat 64 thereat, while the lower end of said passageway opens to atmospheric chamber 57.

A supply-exhaust valve assembly 65 comprises a hollow valve piston 66 coaxially slidably disposed in the upper end of casing 54, the hollow portion of said piston comprising a pressure supply chamber 67 communicating with supply port 34 via an opening 68 and an undercut portion 69 formed on said valve piston. Valve piston 66 has internally coaxially secured therein at the lower end of supply chamber 67 an annular valve seat member 70 having a coaxial bore therein, the upper end of which forms an annular valve seat 71 which faces in an axial direction corresponding to that of exhaust valve seat 64. A spring 72 compressed between the upper side of the transverse wall of guide bushing 60 and the lower side of valve seat member 70 urges valve piston 66 in an upwardly direction, as viewed in the drawings.

A disc-like supply-exhaust valve member 73 is operably disposed within supply chamber 67 and urged toward a seated or closed position on supply valve seat 71 by a relatively light spring 74 compressedly disposed in said supply chamber between said supply-exhaust valve member and the upper wall of valve piston 66. The upper end of piston stem 59 is of sufficently smaller diameter than that of the bore in valve seat member 70 as to permit free axial movement of said upper end of said piston stem into said bore so that exhaust valve seat 64, upon sufficient upward movement of said piston stem, may occupy a seated or closed position on the lower side of supply-exhaust valve member 73, as will be hereinafter explained.

Cam operating rod 9, as shown in FIG. 1, has an axially aligned cam member 75 secured to the free end thereof in cam chamber 11 and characterized by a cam surface 76 of preselected contour, in this instance said cam member being tapered toward each end from the center circumference thereof. A cam follower 77 engaging cam surface 76 is rotatably carried by a support member 78 secured to the upper end of valve piston 66 of relay valve 2 in axial alignment therewith for positioning said valve piston according to the position of said cam follower relative to said cam surface. In FIG. 1, cam member 75 is shown in a central or neutral position in which valve piston 66 is maintained in a lowermost position in casing 54.

The servo positioner shown in FIG. 1 operates in the manner to be presently described. Let it be assumed that both pipes 35 and 47 are charged with fluid at a predetermined pressure sufficient for effecting operation of the servo positioner, and that the position of lever 28 shown in solid outline in FIG. 1 is a central or neutral position designated C. If the operator desires to move lever 28 to the right of position C, or in a clockwise direction, toward a position shown in broken outline and indicated R in the drawing, selector valve 3 is set to effect supply of control fluid to pipe 46 at a selected pressure, depending on the extent to which said lever is to be moved. Pressure at inlet 44 of double check valve 32 causes a check valve element 79 to assume a left-hand position, in which it is shown and in which pipes 45 and 51 are isolated from said pressure while pipe 41 is communicated therewith via outlet 42. Control fluid at the selected pressure is thus supplied to control chamber 56 of relay valve device 2, which causes piston 55 to be moved upwardly against the opposing force of spring 62 until a state of equilibrium is attained.

Piston stem 59, in moving upwardly with piston 55, causes exhaust valve seat 64 to contact and seat against supply-exhaust valve 73 to thereby cut off communication to atmosphere via passageway 63, chamber 57, and port 58. With stem 59 in contact with supply-exhaust valve 73, upward movement of said stem causes unseating of said supply-exhaust valve from valve seat 71 to permit flow of fluid pressure therepast from supply chamber 67 to chamber 12 of power cylinder device 1 via delivery chamber 61, port 36, pipe 37, pipe 38, and port 14. With chamber 12 pressurized, piston 5, rods 6 and 9, and cam member 75 are all moved in a right-hand direction, as viewed in FIG. 1, against the opposing force of spring 16. As cam member 75 moves rightwardly away from its central position, in which it is shown, cam follower 77 rolls onto the smaller diameter portion of cam surface 76 to eventually stop at a position thereon as determined by the final position of piston 5. Thus, while follower 77 is moving along surface 76, spring 72 is effective for causing upward movement of valve piston 66 until cam member 75 attains its final position on said cam surface Upward movement of valve piston 66 carries valve seat member 70 therewith and thereby brings valve seat 71 into contact with supply-exhaust valve member 73, against which, it will be recalled, exhaust valve 64 is maintained seated by pressure acting on control piston 55 in control chamber 56. As a result, both supply and exhaust functions are cut off and all components of power cylinder 1 and relay valve 2 assume a state of equilibrium until such time that a change in the degree of pressure in control chamber 56 is effected by the operator.

The final position assumed by piston 5 of power cylinder device 1, as determined by the pressure prevailing in control chamber 56 of relay valve device 2, determines and sets the position of lever 28 which is rotated, in this case, in a clockwise direction about fulcrum 30 to some position between positions C and R, shown in FIG. 1, depending upon the degree of pressure supplied to chamber 12, as above explained. The position which lever 28 thus assumes is maintained by the cooperative action of cam member 75 and relay valve device 2.

If the operator desires to set lever 28 at its maximum clockwise rotated position defined by position R in FIG. 1, he provides maximum or sufficient pressure in control chamber 56 of relay valve device 2, which acts on control piston 55 and stem 59, to lift supply-exhaust valve 73 to a maximum heighth off valve seat 71. Pressure thus supplied past unseated supply-exhaust valve 73 to chamber 12 to act on piston 5, as above explained, is sufficient for overcoming the opposing force of spring 16 and cause rightward movement of said piston, rods 6 and 9, and cam member 75 to the extreme right position limited by abutment of said piston with separating wall 10. During the time that cam member 75 is moving to its extreme right position and, at the same time, that follower 77 is moving along surface 76 to the smallest diameter thereof, supply-exhaust valve 73, being at its maximum heighth position unseated off valve seat 71, remains in such unseated position for a sufficient length of time to permit sufficient build-up of pressure in chamber 12 of power cylinder 1 for moving piston 5 and, therefore, lever 28 to their respective extreme right positions before valve seat 71 is lifted up by valve piston 66 into contact with and a closed position on said supply-exhaust valve member.

It should be understood that if the operator effects a reduction of pressure in control chamber 56 of relay valve device 2, the positional adjustment of lever 28, that is, counterclockwise rotation thereof from position R toward position C, is effected to a degree corresponding to the degree of pressure reduction.

If the operator desires to switch the position of lever 28 from the right side of position C to the left side thereof or toward an extreme counterclockwise position indicated L in FIG. 1, he operates pressure selector valve 3 to a position in which fluid pressure from pipe 47 is directed to pipe 45 instead of pipe 46 thus causing check valve member 79 of double check valve device 32 to shift positions for closing inlet 44 to outlet 42 and opening inlet 43 thereto. Fluid pressure again is supplied via pipe 41 to control chamber 56 of relay valve device 2 which responds operatively thereto in the manner described above in detail.

It will be noted, however, that with fluid pressure diverted to pipe 45, such pressure also flows via pipe 51 to a pressure inlet 80 of changeover valve device 33, which pressure, even if minimal, is sufficient for overcoming the opposing force of spring 48 and causing said valve device to be shifted from its first position, above defined and in which it shown, shown to its second position above defined in which fluid pressure supplied via pipe 37 is cut off from passageway 49 and pipe 39 and is diverted via passageway 52 to pipe 39 and chamber 13 of power cylinder device 1. In the second position of changeover valve device 33, chamber 12 is vented to atmosphere via pipe 38, and passageway 53.

Subsequently to operation of changeover valve device 33 to its second position, power cylinder device 1 and relay valve device 2 function cooperatively in the manner above set forth in connection with said changeover device in its first position, except that with chamber 13 of said power cylinder device pressurized, lever 28 is rotated to the left of or counterclockwise relative to position C.

It should be apparent that the ball and socket assembly 22 provides the flexibility necessary to permit rotation of lever 28 about fulcrum 30 when effected by axial movement of lever-positioning rod 6 acting through the pivotal connection at 29.

The embodiment of the invention shown in FIG. 2 of the drawings also comprises the relay valve device 2 which is similar to that shown in FIG. 1, and, therefore, similar reference numerals are applied thereto. The embodiment shown in FIG. 2 further comprises a single acting power cylinder device 81 including a casing 82 having a piston reciprocably operable therein, said piston having a lever-positioning rod 84 extending concentrically from one side thereof in sealing and sliding relation through a separating wall 85 into a spring chamber 86 formed at one of said casing. A cam operating rod 87 extends concentrically from the other side of piston 83 with sealing and sliding relation through a separating wall 88 into a cam chamber 89 formed at the end of casing 82 opposite spring chamber 86. Piston 83 cooperates with casing 82 and separating wall 85 to form an operating pressure chamber 90 on the respective side of said piston adjacent said separating wall 85, while an atmospheric chamber 91 is formed on the opposite side of said piston adjacent separating wall 88. Operating pressure chamber 90 opens to a port 92 via which fluid pressure may be supplied directly from delivery port 36 of relay valve device 2 via a pipe 93.

A return spring 94 is compressedly disposed in spring chamber 86 with one end against a spring seat 95 abuttingly engaging separating wall 85 and through which spring seat lever-positioning rod 84 is coaxially slidably movable, the other end of said spring resting against a ball and socket assembly 96 disposed in spring chamber 86 and abuttingly engaging a shoulder 97 formed on an annular retaining member 98 coaxially secured to the end of casing 82 opposite cam chamber 89.

Ball and socket assembly 96 is coaxially secured to the end of rod 84 opposite piston 83 for movement therewith, said ball and socket assembly comprising a ball member 99 conventionally arranged in a socket member 100 and an extension member 101 extending axially from said ball member for pivotal connection to lever 28 at point 29. The arrangement of lever 28 on bracket 31, which is secured to casing 82, is similar to that described above in connection with the embodiment shown in FIG. 1.

Spring 94, acting through ball and socket assembly 96 to which rod 84 is secured, biases piston 83 in a left-hand direction, as viewed in FIG. 2, toward a normal position in which it is shown and in which lever 28 occupies a normal position indicated as N in FIG. 2. When fluid pressure is supplied to operating pressure chamber 90 of power cylinder device 81, in a manner to be hereinafter disclosed, piston 83, rod 84, and ball and socket assembly 96 are all forced toward the right against the opposing force of spring 94, to thereby effect clockwise rotation of lever 28 out of its position N to a position between said position N and a position R determined by maximum clockwise rotation of said lever, which in turn is determined by abutment of said piston with separating wall 88.

The embodiment of the invention shown in FIG. 2 is also provided with a pressure selector valve device 102 interposed between fluid pressure source pipe 47 and pipe 41. In this embodiment, however, since it is necessary to pressurize only one chamber, that is, chamber 90 of single-acting power cylinder device 81, there is no need for a double check valve device and a changeover valve device, such as the devices 32 and 33 of the embodiment shown in FIG. 1. Selector valve device 102 merely functions to provide fluid pressure to control chamber 56 of relay valve device 2 at the degree selected by the operator.

Also in accordance with the invention, the embodiment shown in FIG. 2 includes a cam member 103 having a tapered cam surface 104 corresponding to the left-hand portion of cam surface 76 of FIG. 1 for engagement by cam follower 77.

The operation of the embodiment shown in FIG. 2 is similar to that of the embodiment shown in FIG. 1, as above described, except that relay valve device 2 is employed to provide operating presure to chamber 90 only of the power cylinder device 81, so that axial displacement of piston 83, lever-positioning rod 84, and extension member 101 is in a right-hand direction only, when said chamber is pressurized or the pressure therein increased in a manner to that described above in connection with pressurization of chamber 12 of the embodiment shown in FIG. 1 of the drawings. Such axial movement in a right-hand direction, of course, causes clockwise rotation of lever 28 from position N toward position R. It should be understood that if pressure in chamber 90 is reduced or completely released, also in a manner similar to that discussed above in connection with the embodiment shown in FIG. 1, return spring 94 causes lever 28 to be rotated in a counterclockwise direction toward position N. Thus, all the various positions to which lever 28 in the embodiment shown in FIG. 2 may be operated, lie between position N and position R only, that is, to the right side of position N and not to both sides thereof, as in the case of the embodiment shown in FIG. 1 in which lever 28 is operable to both sides of the central position C.

Having now described the invention what I claim as new and desire to secure by Letters Patent, is:

1. Servo positioner apparatus for selectively positioning a mechanical member in a desired position until a change is effected, said servo positioner apparatus comprising:

a. a double acting piston device including a power piston connected to the mechanical member and alternatively subjectable on opposite sides to operating fluid pressure for effecting operation of the mechanical member to respective pluralities of different positions in opposite directions from a normal central position, depending upon which of said opposite sides is subjected to said operating fluid pressure and the degree thereof;

b. control valve means having a cut-off position in which a supply communication, via which operating fluid pressure may be supplied to said power piston, is closed, and being operable, in response to a variable control fluid pressure, to one of a plurality of supply positions in which said supply communication is open for supplying said operating fluid pressure to said power piston at a degree commensurate with the degree of said control fluid pressure;

c. force balancing means including:

i. a spring disposed at one side of said power piston for exerting a biasing force on and urging the power piston toward its said normal central position in opposition to the operating pressure acting thereon, said power piston and the mechanical member assuming one of said plurality of different positions upon attainment of a balanced state between the opposing forces of said spring and said operating pressure acting on the power piston, and ii. a cam member connected to and positionally movable with said power piston and having a cam surface of predetermined contour operatively engaging said control valve means, said cam surface being operable to one of a plurality of cam positions relative to the control valve means, such cam position corresponding to said one of said plurality of different positions of the mechanical member, for exerting a counter force on said valve means in opposition to said control fluid pressure to produce a balanced state therebetween and in which said control valve means is maintained in said one of said plurality of supply positions;

d. respective delivery pipes connecting to said opposite sides of said power piston; and e. a changeover valve device interposed between said delivery pipes and said control valve means, f. said changeover valve device normally biased to a first position in which one of said delivery pipes is communicated with the control valve means for effecting supply of operating pressure to one of said opposite sides of the power piston, and being operable responsively to actuating fluid pressure to a second position in which said one of said delivery pipes is cut off from said control valve means and the other is communicated therewith for effecting supply of operating pressure to the other of said opposite sides of the power piston.

2. Servo positioner apparatus, as set forth in claim 1, further characterized by an operator's pressure selector valve means selectively operable to one position, in which said changeover valve device is relieved of said actuating fluid pressure, and to another position in which said changeover valve device is supplied with actuating fluid pressure, said pressure selector valve means also being operable for selectively controlling the degree of control fluid pressure supplied to the control valve means.

* * * * *